United States Patent [19]

Germ

[11] Patent Number: 4,886,473

[45] Date of Patent: Dec. 12, 1989

[54] IGNITION TERMINAL ASSEMBLY

[75] Inventor: Kenneth B. Germ, Niles, Ohio

[73] Assignee: General Motors Corporation, Detroit, Mich.

[21] Appl. No.: 296,562

[22] Filed: Jan. 13, 1989

[51] Int. Cl.[4] ..... H01R 13/52
[52] U.S. Cl. ..... 439/847
[58] Field of Search ..... 439/818, 827, 833, 837, 439/839, 846, 847

[56] References Cited

U.S. PATENT DOCUMENTS

| | | | |
|---|---|---|---|
| 2,206,672 | 7/1940 | Pederquist | 439/847 |
| 3,031,638 | 4/1962 | Bertram et al. | 439/847 |
| 3,223,963 | 12/1965 | Rarey et al. | 439/847 |
| 3,364,459 | 1/1968 | Schiller | 339/245 |
| 4,009,924 | 3/1977 | Bungo et al. | 339/223 |

OTHER PUBLICATIONS

Packard Electric Catalog p. H-12 dated (1-87).

*Primary Examiner*—Joseph H. McGlynn
*Attorney, Agent, or Firm*—F. J. Fodale

[57] ABSTRACT

An ignition terminal assembly for attachment to an ignition cable comprises an elongated terminal and a C-shaped retention clip. The elongated terminal has a forward contact cup which a wide gap at the front end which allows the ignition terminal assembly to be disconnected from a mating terminal at a substantial angle without distorting and damaging the ignition terminal assembly. The elongated terminal has an intermediate wall which is joined to the top wall of the contact cup above of the longitudinal centerline of the elongated terminal and to a closed bottom wall of a crimp barrel below the longitudinal centerline so that intermediate wall forms a stop for ignition cable which is attached to the terminal assembly by the crimp barrel.

3 Claims, 1 Drawing Sheet

IGNITION TERMINAL ASSEMBLY

BACKGROUND OF THE INVENTION

This invention relates generally to ignition terminals and more specifically to two-piece ignition terminal assemblies.

Ignition terminal assemblies of two-piece construction are produced by the Packard Electric Division of General Motors Corporation and other manufacturers. Such terminal assemblies are also disclosed in U.S. Pat. Nos. 3,364,459 granted to Leslie L. Schiller Jan. 16, 1968 and 4,009,924 granted to Edward M. Bungo and Lloyd D. Jack Mar. 1, 1977.

The two-piece ignition terminal assemblies known in the prior art conventionally comprise a stamped and bent sheet metal terminal which is easily crimped onto the end of an ignition cable and a retention clip of spring tempered steel which mounts on the receptacle of the terminal to retain the mating terminal in the receptacle with a snap action.

SUMMARY OF THE INVENTION

The object of this invention is to provide an improved two-piece ignition terminal assembly.

A feature of the invention is that the receptacle and retention clip are designed so that the terminal assembly can be disconnected from its mating terminal, such as a spark plug terminal, at a substantial angle without distorting and damaging the ignition terminal assembly.

Another feature of the invention is that terminal has a receptacle and a crimp barrel which are oriented and interconnected by an intermediate wall which provides a forward stop for the ignition cable and which provides a protective surface which guards against the ignition cable core getting nicked.

Other objects and features of the invention will become apparent to those skilled in the art as disclosure is made in the following detailed description of a preferred embodiment of the invention which sets forth the best mode of the invention contemplated by the inventor and which is illustrated in the accompanying sheet of drawing.

DETAILED DESCRIPTION OF THE PREFERRED EMBODIMENT

Figure 1:
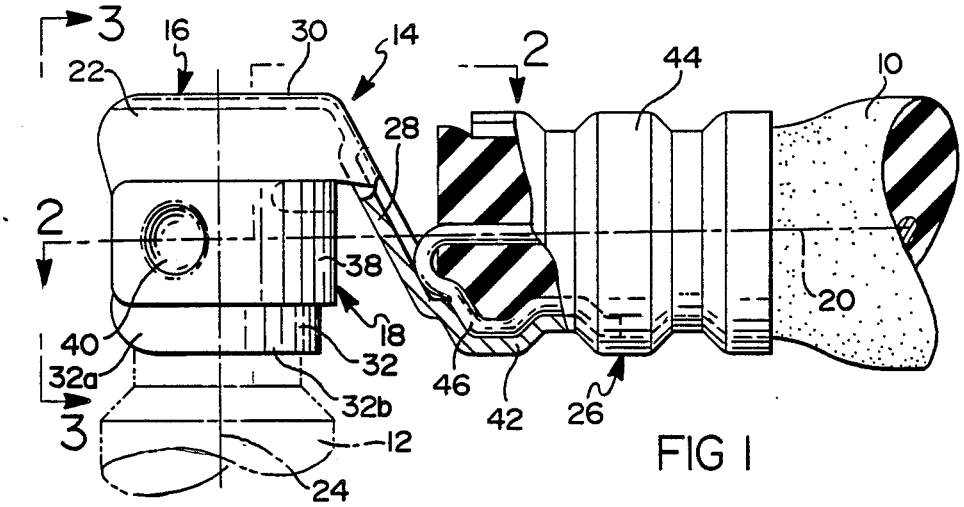
FIG. 1 is a side view of an ignition cable attached to a spark plug by an ignition terminal assembly in accordance with the invention.

Referring now to the drawing, an ignition cable 10 is attached to a spark plug 12 by an ignition terminal assembly 14. The ignition terminal assembly 14 which is of two piece construction comprises an elongated terminal 16 of stamped sheet metal construction and a C-shaped retention clip 18 of spring tempered steel.

The elongated terminal 16 has a longitudinal centerline 20 and a receptacle at one end in the form of a forward contact cup 22. The contact cup 22 has a centerline 24 which is perpendicular to the longitudinal centerline 20. The elongated terminal 16 further comprises a rearward crimp barrel 26 which is parallel to the longitudinal centerline 20 and an intermediate wall 28 which joins the forward contact cup 22 to the rearward crimp barrel 26.

Figure 2:
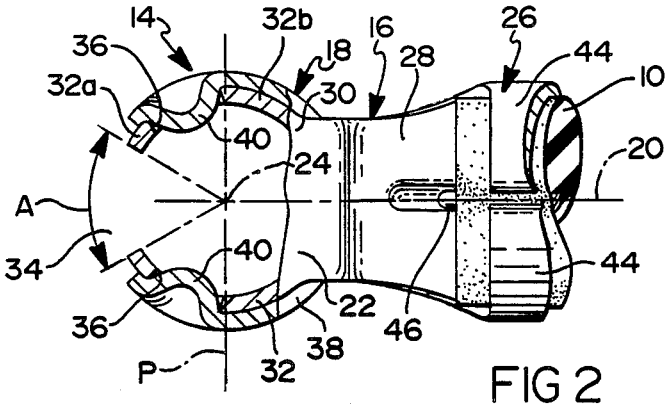
FIG. 2 is a section taken substantially along the line 2—2 of FIG. 1 looking in the direction of the arrows.

The contact cup 22 has a top wall 30 and a cylindrical side wall 32 which has a forward half **32*a* and a rearward half 32*b*. The forward half 32*a* is forward of the bisector plane P which is perpendicular to the longitudinal centerline 20 and contains the cup centerline 24 as shown in FIG. 2. The rearward half 32*b*** is rearward of the bisector plane P.

Figure 3:
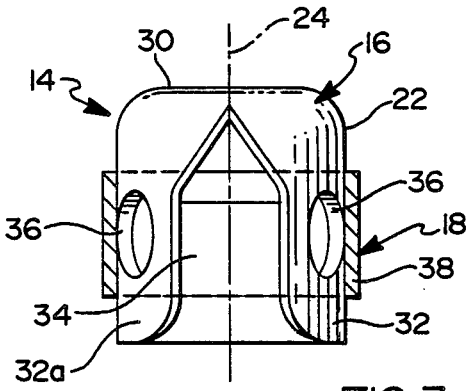
FIG. 3 is a front view taken substantially along the line 3—3 of FIG. 1 looking in the direction of the arrows.

The forward half **32*a* of the cylindrical side wall 32 has a wide gap 34 at the front end of the contact cup 32. The wide gap 34 has a mid portion which has a constant circumferential width and which subtends an angle A of about 60 degrees as shown in FIGS. 2 and 3. The upper portion of the gap 34 is wedge shaped and the lower portion is radiused outwardly as shown in FIG. 3. The wide gap 34 allows the ignition terminal assembly 14 to be disconnected from the mating terminal of the spark plug 12 at a substantial angle without distorting and damaging the ignition terminal assembly 14**. By substantial angle, I mean up to about 60 degrees from the horizontal.

The forward half **32*a* of the cylindrical side wall 32 further comprises a pair of apertures 36 on either side of the wide gap 34. The apertures 36 are used to mount the C-shaped retention clip 18 on the contact cup 22**.

The C-shaped retention clip 18 has a circumferential wall 38 which defines a gap and a pair of dimples 40 at the respective ends of the circumferential wall 38 adjacent the gap. The C-shaped retention clip 18 is mounted on the contact cup 22 so that pair of dimples 40 project into the interior of the contact cup 22 through the pair of apertures 36 and the C-shaped retention clip 18 embraces the rearward half **32*b* of the cylindrical side wall 32 of the contact cup 22 as best shown in FIG. 2**.

Positioning the C-shaped retention clip 18 on the contact cup 22 in this manner allows the wide gap 34 in the front end of the contact cup 22 to be used to disconnect the ignition terminal assembly at a substantial angle. The gap of the C-shaped retention clip 18 is also preferably slightly wider than the wide gap 34 at the front end of the contact cup 22, as shown in FIG. 2, so that the C-shaped retention clip 18 ring does not interfere with angular removal of the ignition terminal assembly 14.

The rearward crimp barrel 26 which attaches the ignition terminal assembly 14 to the ignition cable 10 has a closed bottom wall 42 beneath the longitudinal centerline 20 and an open top between the side wings 44 for receiving the ignition cable 10. The side wings 44 are crimped over the top on the ignition cable 10 after it is laid on the closed bottom wall 42 in a conventional manner as shown in FIG. 2.

The intermediate wall 28 which interconnects the contact cup 22 and the crimp barrel 26 is slanted and joined to the top wall 30 of the contact cup 22 above the longitudinal centerline of the elongated terminal 16 and to the closed bottom wall 42 of the crimp barrel 26 below the longitudinal centerline 20 so that intermediate wall 28 forms a stop for ignition cable 10 which is attached to the ignition terminal assembly 14 by the crimp barrel 26. The slanted intermediate wall 28 also provides a protective surface which guards against the conductive core 46 of the ignition cable 10 getting nicked during the assembly operation and subsequent use.

I wish it to be understood that I do not desire to be limited to the exact details of construction shown and described, for obvious modifications will occur to a person skilled in the art.

The embodiments of the invention in which an exclusive property or privilege is claimed are defined as follows:

1. An ignition terminal assembly for attachment to an ignition cable comprising:

an elongated terminal having a longitudinal centerline and a C-shaped retention clip, the elongated terminal having a forward contact cup which has a centerline which is transverse to the longitudinal centerline of the elongated terminal; a rearward crimp barrel which is parallel to the longitudinal centerline of the elongated terminal; and an intermediate wall which joins the forward contact cup to the rearward crimp barrel, the contact cup having a top wall and a cylindrical side wall which has a forward half and a rearward half, the forward half of the cylindrical side wall having a wide gap at the front end of the contact cup which allows the ignition terminal assembly to be disconnected from a mating terminal at a substantial angle without distorting and damaging the ignition terminal assembly and a pair of opposed apertures on either side of the wide gap, the C-shaped retention clip having a circumferential wall which defines a gap and a pair of dimples at the respective ends of the circumferential wall adjacent the gap, and the C-shaped retention clip being mounted on the contact cup so that pair of dimples project into the interior of the contact cup through the pair of apertures and the C-shaped retention clip embraces the rearward half of the cylindrical side wall of the contact cup so that the C-shaped retention clip does not interfere with the ignition terminal assembly being disconnected at a substantial angle.

2. The ignition terminal assembly as defined in claim 1 wherein the rearward crimp barrel has a closed bottom wall and an open top for receiving the ignition cable, and the intermediate wall is joined to the top wall of the contact cup and to the closed bottom wall of the crimp barrel so that intermediate wall forms a stop for ignition cable which is attached to the terminal assembly by the crimp barrel.

3. An ignition terminal assembly for attachment to an ignition cable comprising:

an elongated terminal having a longitudinal centerline and a C-shaped retention clip, the elongated terminal having a forward contact cup which has a centerline which is perpendicular to the longitudinal centerline of the elongated terminal; a rearward crimp barrel which is parallel to the longitudinal centerline of the elongated terminal; and an intermediate wall which joins the forward contact cup to the rearward crimp barrel, the contact cup having a top wall and a cylindrical side wall which has a forward half and a rearward half, the forward half of the cylindrical side wall having a wide gap at the front end of the contact cup which allows the ignition terminal assembly to be disconnected from a mating terminal at a substantial angle without distorting and damaging the ignition terminal assembly and a pair of opposed apertures on either side of the wide gap, the C-shaped retention clip having a circumferential wall which defines a gap and a pair of dimples at the respective ends of the circumferential wall adjacent the gap, the C-shaped retention clip being mounted on the contact cup so that pair of dimples project into the interior of the contact cup through the pair of apertures and the C-shaped retention clip embraces the rearward half of the cylindrical side wall of the contact cup, the gap of the C-shaped retention clip being wider than the wide gap at the front end of the contact cup so that the C-shaped retention clip does not interfere with the ignition terminal assembly being disconnected at a substantial angle, the rearward crimp barrel having a closed bottom wall and an open top for receiving the ignition cable, and the intermediate wall being joined to the top wall of the contact cup above the longitudinal centerline of the elongated terminal and to the closed bottom wall of the crimp barrel below the longitudinal centerline so that intermediate wall forms a stop for ignition cable which is attached to the terminal assembly by the crimp barrel.

* * * * *